US006406333B2

(12) United States Patent
Harris

(10) Patent No.: US 6,406,333 B2
(45) Date of Patent: Jun. 18, 2002

(54) QUICK-FIT LIGHT FIXTURE

(76) Inventor: John Harris, 14104 Laurel Rd., Minnetonka, MN (US) 55305

( * ) Notice: Subject to any disclaimer, the term of this patent is extended or adjusted under 35 U.S.C. 154(b) by 0 days.

(21) Appl. No.: 09/791,136

(22) Filed: Feb. 22, 2001

Related U.S. Application Data

(60) Provisional application No. 60/183,918, filed on Feb. 22, 2000.

(51) Int. Cl.[7] ..... H01R 17/18

(52) U.S. Cl. ..... 439/668; 439/667; 313/318.09

(58) Field of Search ..... 439/668, 667, 439/253, 628, 699; 313/318.09, 318.1

(56) References Cited

U.S. PATENT DOCUMENTS

| | | | | |
|---|---|---|---|---|
| 1,104,577 | A | | 7/1914 | Thomas |
| 1,187,301 | A | | 6/1916 | Goodridge |
| 1,262,936 | A | * | 4/1918 | Fowler |
| 1,640,189 | A | | 8/1927 | Hamiel |
| 2,025,564 | A | | 12/1935 | Blake |
| 2,122,848 | A | | 7/1938 | Stearns |
| 2,791,679 | A | | 5/1957 | Hierholzer, Jr. |
| 3,465,284 | A | | 9/1969 | McManus |
| 3,633,023 | A | | 1/1972 | Castiglioni |
| 4,100,448 | A | * | 7/1978 | Chipner et al. ..... 313/318 |
| 4,121,134 | A | * | 10/1978 | Fontenelle ..... 315/64 |
| 4,902,251 | A | | 2/1990 | Grzena |
| 4,915,667 | A | | 4/1990 | Tobias-Pader |
| 4,940,422 | A | | 7/1990 | Forish et al. |
| 5,380,214 | A | | 1/1995 | Ortega, Jr. |
| 5,382,181 | A | | 1/1995 | Ortiz |
| 5,521,460 | A | * | 5/1996 | Zhu ..... 313/318.09 |

FOREIGN PATENT DOCUMENTS

| | | |
|---|---|---|
| FR | 1360607 | 3/1964 |

* cited by examiner

*Primary Examiner*—P. Austin Bradley
*Assistant Examiner*—Alexander Gilman
(74) *Attorney, Agent, or Firm*—Daniel A. Rosenberg; Kent A. Herink; Davis Brown Law Firm

(57) ABSTRACT

A fixture comprised of a base and a tensioning member integrated within the base provides a flexible tensioning force to retain a light bulb within the fixture. The light bulb can be a standard bulb, or a threadless bulb specifically designed for the fixture of the present invention.

2 Claims, 5 Drawing Sheets

Fig. 3A
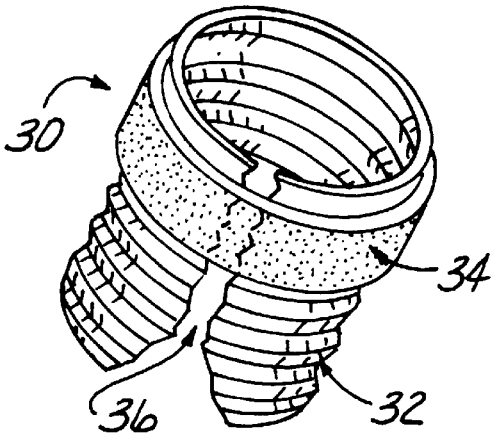
Fig. 3B
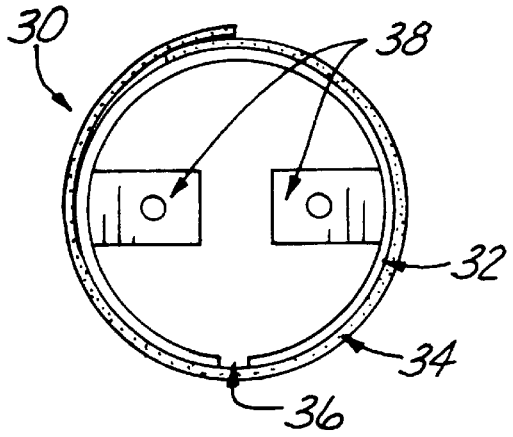
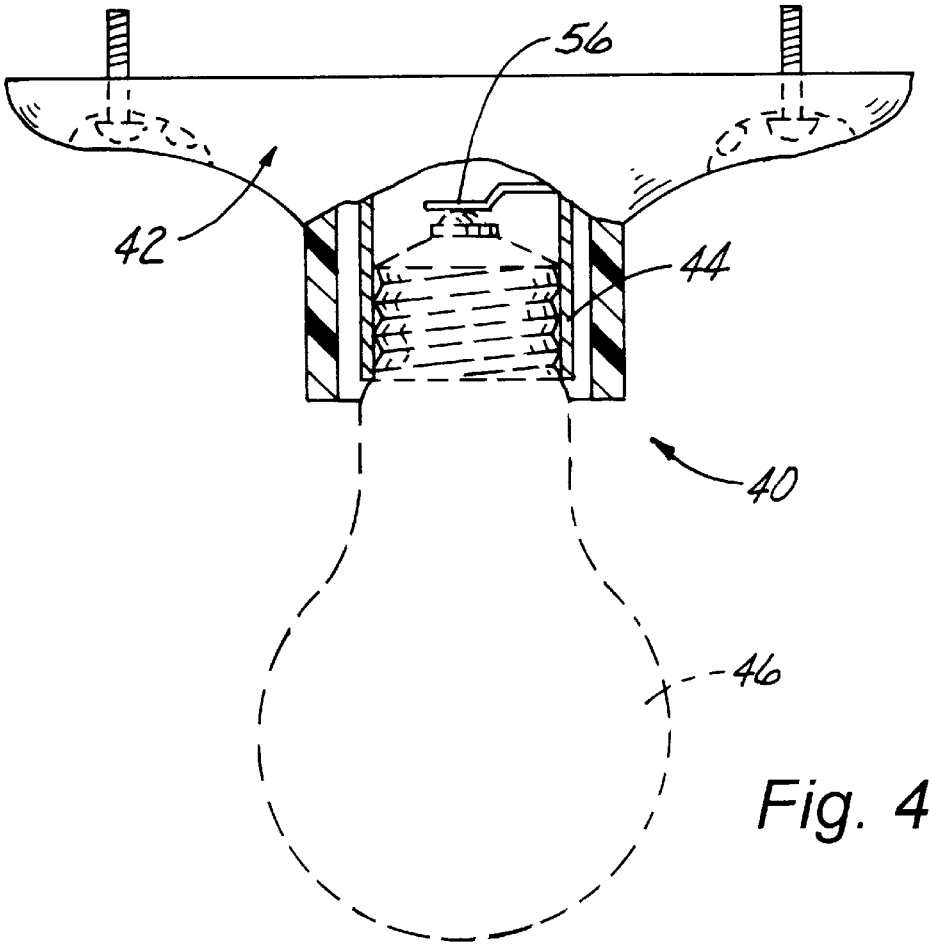
Fig. 4

QUICK-FIT LIGHT FIXTURE

RELATED APPLICATIONS

Priority is hereby claimed to U.S. Provisional Patent Application No. 60/183,918, filed Feb. 22, 2000, entitled QUICK-FIT LIGHT FIXTURE.

BACKGROUND OF THE INVENTION

The present invention relates to a quick-fit light fixture. In particular, to a light fixture that enables the insertion and retraction of a light bulb without the use of threads.

The use of threaded light bulbs for receipt within threaded light fixtures likely dates back to the very beginning of the art. For many people, the use of threaded bulbs and fixture presents problems. After long periods of use the bulb can freeze in place and require the application of substantial force to remove. This proves dangerous in that bulbs can break within a fixture causing injury, and making removal of the threaded base nearly impossible. Furthermore, for elderly or others with weakened grips the threaded bulb can prove very difficult to manipulate. Additionally, a threaded bulb requires some skill and time to thread in and out, especially in consideration of the remote location of many light fixtures. Numerous examples of attempts to alleviate these difficulties exist in the prior art.

In particular, U.S. Pat. No. 5,380,214 (Ortega, Jr.) teaches the use of two interior contacts that engage the threads of a conventional light bulb to allow for the insertion and removal of a light bulb without rotating the bulb. The contacts consist of two narrow elongated bands bent to capture a threaded bulb. This type of design, however, requires substantial modification of the traditional fixture. It also increases the number of installed parts and would add to the time and cost of producing a suitable fixture.

U.S. Pat. No. 5,382,181 (Ortiz) teaches the use of a threaded adapter for use with conventional light fixtures. The adapter uses three internal spring retainers to apply pressure to capture the threads of a conventional light bulb. Again, this design proves less desirable in that the increased number of parts increases the cost of manufacture.

U.S. Pat. No. 4,902,251 (Grzena) shows a specialized solution for use with wedge based lamp bulbs. The socket includes a spring contact arm and detent arm to capture the bulb. However, this comprises a highly specialized application that lacks wide spread applicability.

U.S. Pat. No. 2,025,564 (Blake) shows still another electrical socket that uses elongated contact fingers to capture a specialty bulb within a socket. This application appears tailored to strings of lights commonly used at Christmas time.

U.S. Pat. No. 2,122,848 (Stearns) shows the use of a coiled circular spring, presumably, to provide tension on two flanges to hold a bulb in place. This design also suffers from the drawback of unnecessary complexity that would make the design difficult to manufacture at a competitive cost.

U.S. Pat. No. 4,940,422 (Forish et al.) shows a design for a lamp socket assembly for automotive applications. The design uses a complicated locking lug and socket assembly to retain a bulb for use, for example, in a tail light assembly. This represents a specialized application that would prevent widespread use in common household situations.

Other examples exist in the art, however, to date a truly universal, flexible, low cost, easy to use alternative to the standard threaded bulb and fixture design has yet to be developed. Thus, a need exists in the art for a quick-fit snap in and out fixture for use with standard light bulbs and/or fixtures.

SUMMARY OF THE INVENTION

An object of the present invention comprises providing a light fixture that allows for direct insertion and removal of a light bulb.

These and other objects of the present invention will become apparent to those skilled in the art upon reference to the following specification, drawings, and claims.

The present invention intends to overcome the difficulties encountered heretofore. To that end, a fixture comprised of a base and a tensioning member integrated with the base provides a flexible tensioning force to retain a light bulb within the fixture.

BRIEF DESCRIPTION OF THE DRAWINGS

FIG. 3*a* is a perspective view of another alternative fixture.

FIG. 3*b* is a top plan view of the fixture of FIG. 3*a*.

FIG. 4 is a side elevational partial cross-sectional view of yet another alternative fixture.

DETAILED DESCRIPTION OF THE INVENTION

Figure 1A:
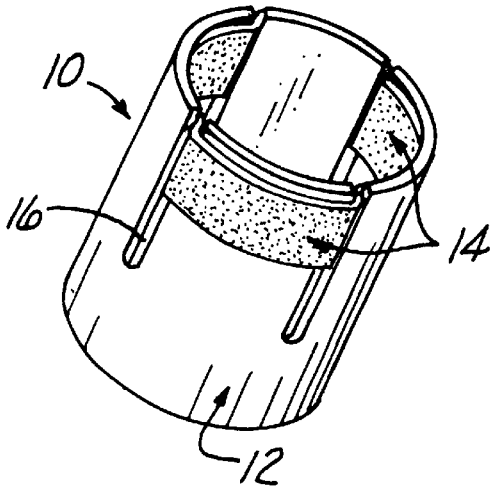
FIG. 1*a* is a perspective view of a fixture.
Figure 1B:
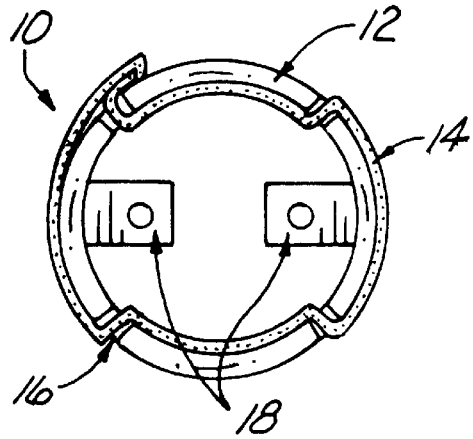
FIG. 1*b* is a top plan view of the fixture of FIG. 1*a*.

In the Figures, FIG. 1*a* shows a first embodiment of the present invention. A light bulb fixture 10 is shown, comprising a pressed fit liner/insert 12 and a flat tension spring 14. The liner 12 contains slits 16 spaced periodically about the upper portion of the liner 12. The slits provide the ability to weave the spring 14 around the upper portion of the liner 12. The spring 14 is biased to provide for inward pressure on the liner 12 sufficient to grasp a light bulb (not shown). FIG. 1*b* shows that riveting contact mounts 18 affix to the inside of the liner 12. The mounts 18 provide a means for attaching the fixture 10 to a base (not shown).

In this manner, a conventional light bulb can be directly inserted and retracted from the fixture 10 without use of fixture threads. The spring 14 provides a force to keep the bulb in place, but also allows for easy removal. The fixture 10 is simply to use and manufacture and greatly simplifies the process of replacing a light bulb. The fixture 10 can mount to a conventional light fixture. For example, with mounts 18 or by securing threads to the bottom of the liner 12 of the fixture 10 it could easily adapt to thread into standard threaded fixtures.

Figure 2A:
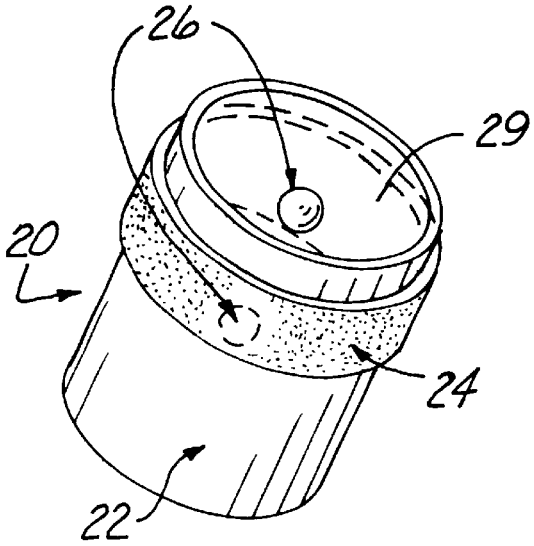
FIG. 2*a* is a perspective view of an alternative fixture.
Figure 2B:
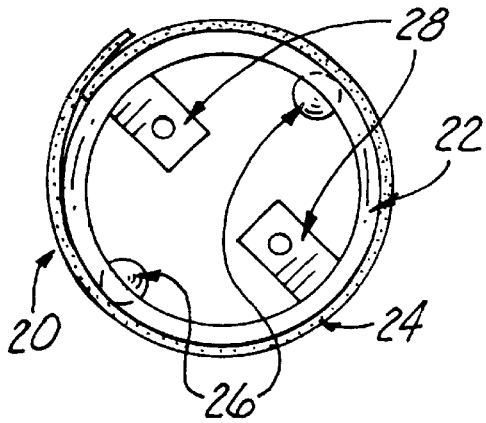
FIG. 2*b* is a top plan view of the fixture of FIG. 2*a*.

FIGS. 2*a* and 2*b* show an alternative embodiment of the present invention. A fixture 20 is shown comprised of a pressed fit liner 22, a flat tension spring 24, and check balls 26. The spring 24 is formed to fit around the upper end of the liner 22. The liner 22 also contains holes 29 sized to receive the check balls 26. The diameter of the holes 29 is slightly less than the diameter of the check balls 26 to prevent the check balls 26 from passing through the holes 29. The spring 24 presses the check balls 26 into the holes 29. The check balls 26 provide a positive interior stop to retain a light bulb in the fixture 20. The fixture 20 also includes mounts 28. Otherwise, the fixture 20 achieves the same purpose, function, and advantages as described with regard the fixture 10.

FIGS. 3*a* and 3*b* show a fixture 30. The fixture includes a standard threaded socket insert 32 with a slit 36. A flat tension spring 34 provides a biasing force to compress the insert 32 to grasp a light bulb. Thus, the slit 36 allows for contraction and expansion of the insert 32 to allow for insertion and removal of the light bulb. The fixture 30 also contains mounts 38 or can simply thread into a standard base.

Figure 5:
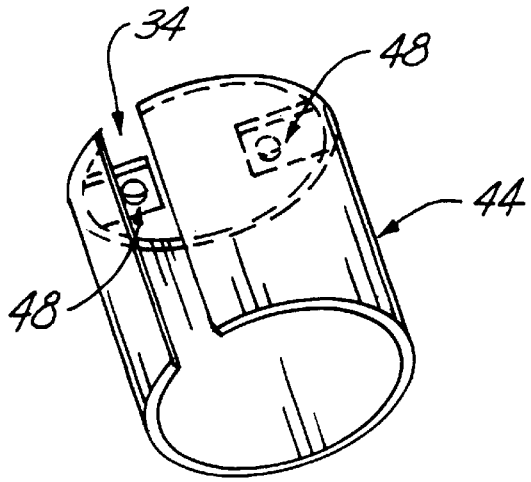
FIG. 5 is a perspective view of the liner of the fixture of FIG. 4.
Figure 6:
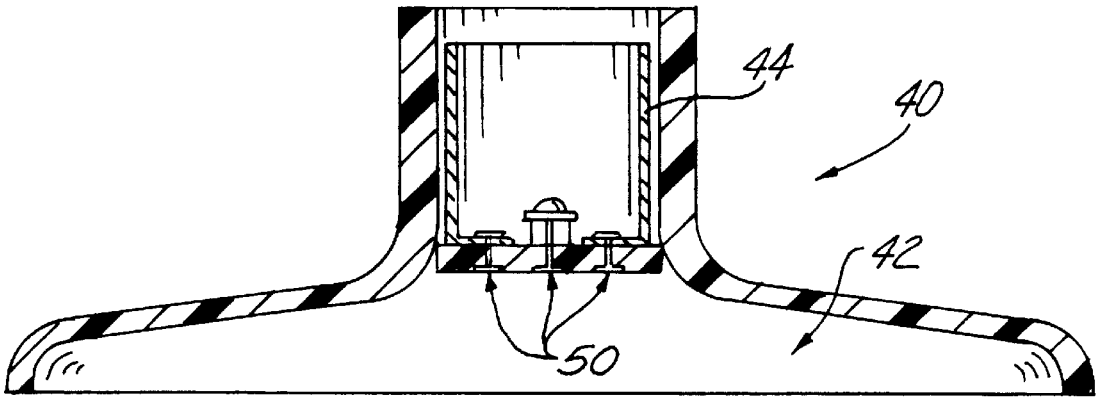
FIG. 6 is a side elevational cross-sectional view of the fixture of FIG. 4.
Figure 7:
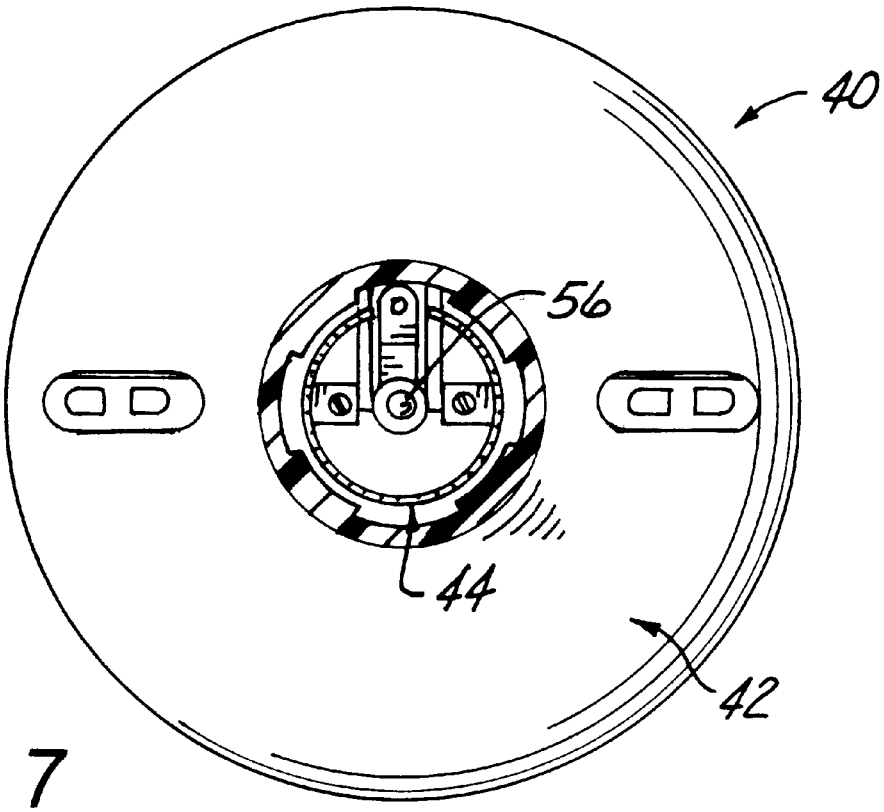
FIG. 7 is a top plan view of the fixture of FIG. 4.
Figure 8:
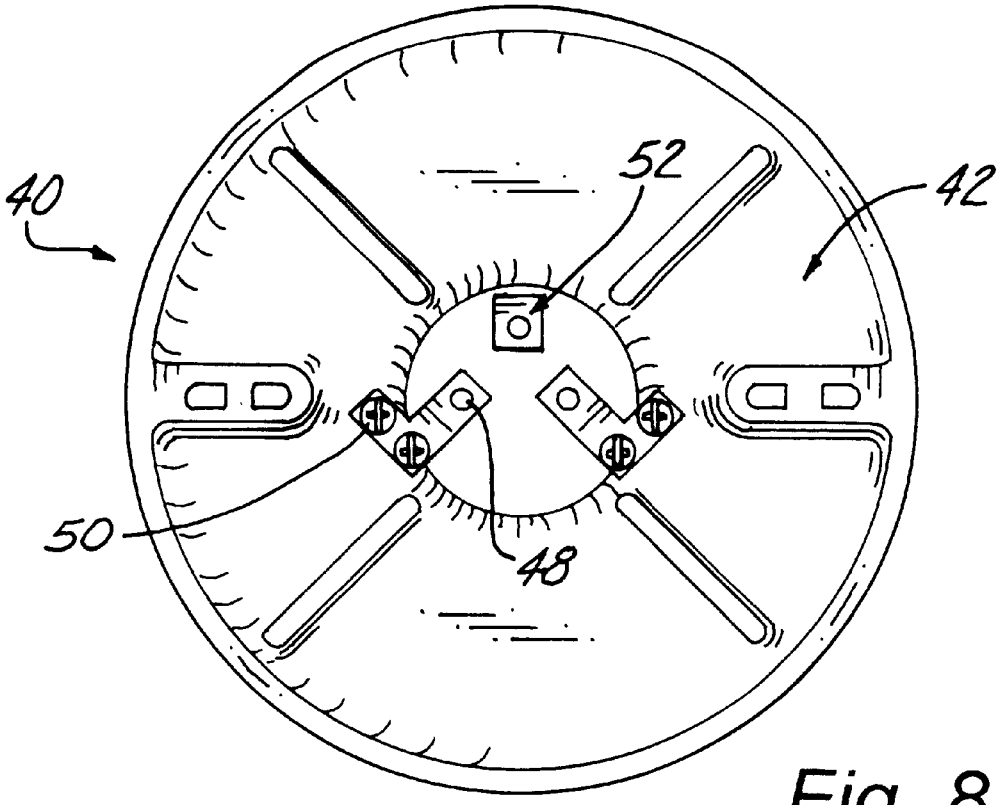
FIG. 8 is a bottom plan view of the fixture of FIG. 4.

FIGS. 4–8 show yet another embodiment of the present invention. FIG. 4 shows a fixture 40 with a standard fixture base 42. Within the interior of the upper portion of the base 42 is a pressed fit insert/liner 44. FIG. 5 shows that the liner 44 is generally semi-circular in shape with an open slit 54. The slit 54 in the liner 44 provides the ability to expand and contract in response to the insertion and removal of a light bulb 46 from the fixture 40. The liner 44 is biased to achieve sufficient force to retain the light bulb 46, but not such force that would create difficulty in removing the light bulb 46 from the fixture 40. The liner 44 also contains riveting mounts 48 to allow securement of the liner 44 to the fixture base 42. FIG. 6 shows that rivets 50 secure the liner 44 to the fixture base 42. FIG. 8 shows that on the underside of the fixture 40, mounts 50 secure to the base 42. Washers 52 extend from the mounts 50 to provide additional securement for the liner 44. FIG. 7, and FIG. 4 show a centrally located contact 56 that provides for transfer of current to the light bulb 46 during operation.

Figure 9A:
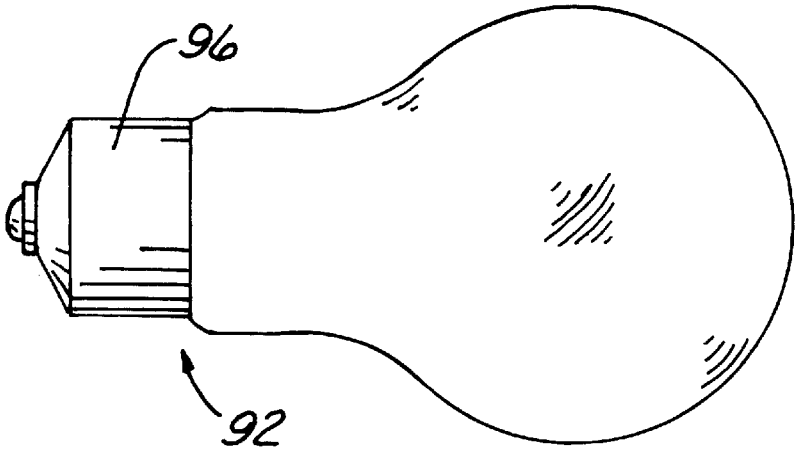
FIG. 9*a* is a side elevational view of a threadless light bulb.
Figure 9B:
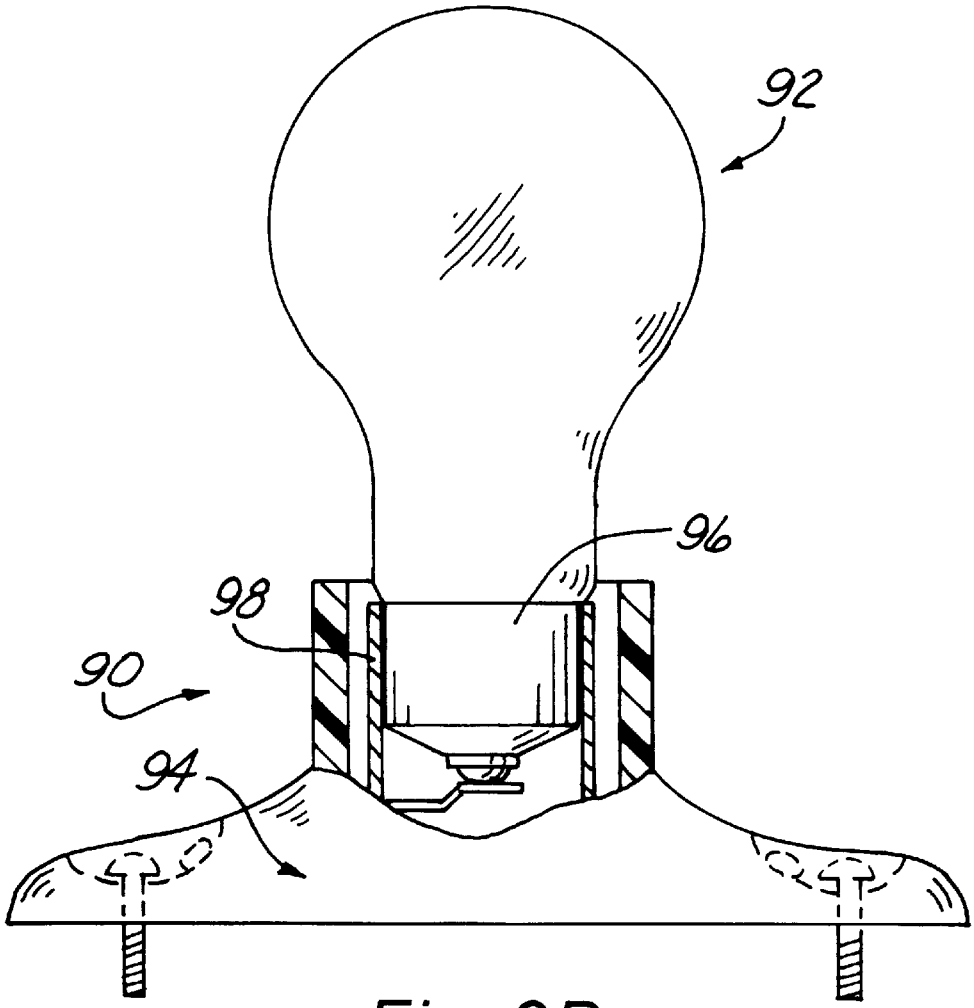
FIG. 9*b* is a side elevational partial cross-sectional view of the fixture of FIG. 4.

FIGS. 9*a* and 9*b* show a variation of the embodiment of the invention as depicted in FIGS. 4–8. In particular, FIG. 9*a* shows a light bulb 92 with a threadless base 96. The light bulb 92 is designed for use with the fixture 90 depicted in FIG. 9*b*. A pressed fit liner/insert 98 is biased to hold the base 96 of the bulb 92 in place. The fixture 90 is similar in design and function to the fixture 40 shown in FIGS. 4–8. The threadless light bulb 92 has the advantage of presenting a uniform surface for retention by the liner 98, which should make the bulb 92 easier to insert and remove than a standard threaded light bulb.

Each of the embodiments of the present invention, comprise an efficient easy to manufacture alternative to the traditional threaded bulb and fixture design. The present invention allows for easier insertion and removal of light bulbs by eliminating the need to turn the bulb in or out of the threads. This allows for direct insertion and removal of the light bulb for greater ease of use without any sacrifice in safety or functionality. In this manner, the present invention substantially eliminates the problems associated with prior art light bulb fixtures.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

What is claimed is:

1. A light fixture and light bulb combination for non-threaded engagement therein, said combination comprising:

a base wire to provide for electrical current and with an electrical contact;

a liner having slits and fitted within said fixture;

a spring engaged within said liner to provide a variable tensioning force, wherein said spring is woven through said slits in said liner and said spring compresses said slits in said liner; and a light bulb for releasable engagement within said liner, and wherein said light bulb engages with said contacts of said base, and wherein said tensioning force applied by said spring retains said bulb and allows for direct removal of said bulb by hand.

2. The invention in accordance with claim 1 wherein said light bulb is a threadless light bulb.

* * * * *